United States Patent [19]

Dirk

[11] 3,944,381

[45] Mar. 16, 1976

[54] COMPRESSOR VALVING

[75] Inventor: William R. Dirk, Fort Worth, Tex.

[73] Assignee: Lennox Industries Inc., Marshalltown, Iowa

[22] Filed: Dec. 3, 1973

[21] Appl. No.: 421,237

[52] U.S. Cl. ..... 417/564

[51] Int. Cl.[2] ..... F04B 21/02

[58] Field of Search..... 137/516.15, 516.17, 516.19, 137/516.21, 516.23; 417/462–464; 29/156.7 R, 156.7 A

[56] References Cited

UNITED STATES PATENTS

| | | | |
|---|---|---|---|
| 1,616,128 | 1/1927 | Vinox | 417/562 |
| 2,626,776 | 1/1953 | Martineau | 29/156.7 A |
| 2,763,425 | 9/1956 | Sahle | 417/562 |
| 2,935,248 | 5/1960 | Gerteis | 417/564 |
| 2,955,749 | 10/1960 | Tomkowiak | 417/564 |
| 3,136,478 | 6/1964 | Soumerai | 417/564 |
| 3,273,591 | 9/1966 | Stewart | 137/516.23 |
| 3,643,687 | 2/1972 | Hudson | 137/516.17 |
| 3,777,779 | 12/1973 | Schwaller | 137/156.21 |
| 3,786,834 | 1/1974 | Garland | 417/564 |

*Primary Examiner*—William L. Freeh

*Attorney, Agent, or Firm*—Molinare, Allegretti, Newitt & Witcoff

[57] ABSTRACT

Valve means for use in a reciprocating compressor having cylinder means with a piston operable therein. The valve means include an inlet body and a discharge valve assembly, with the inlet body having a base incorporating an inner wall member and an outer wall member extending therefrom in spaced, concentric relationship. The wall members have a plurality of spaced recesses therein and a top is secured to the wall members remote from the base so as to define a passageway having a plurality of openings in both the inner wall member and the outer wall member. The volume of internal flow passages is relatively large and thus there is reduced pressure drop of gas passing through the inlet body. The base and the top are bonded to one another by brazing to form the inlet body. The construction is simple, is readily fabricated by mass production techniques, and is relatively inexpensive.

5 Claims, 6 Drawing Figures

COMPRESSOR VALVING

SUMMARY OF THE INVENTION

The present invention pertains to valve means for controlling the passage of gases within a reciprocating compressor and more particularly, to improved valve means that can be readily fabricated in a relatively inexpensive fashion, that are reliable in use, and that if need be, can quickly be replaced as a unit within the reciprocating compressor.

It is known in the prior art to fabricate valve means by casting components and then drilling and otherwise machining same. The separate pieces are then joined together and inserted into the compressor over the end of the cylinder. An example of such prior art construction is found in Neeson U.S. Pat. No. 2,137,965.

A subsequent technique for fabricating the valve means for a reciprocating compressor is disclosed in Gerties U.S. Pat. No. 2,935,248 wherein the valve assembly includes a valve plate with a plurality of annularly disposed holes. A circular discharge valve is connected to the plate and adapted to seat over the holes. Encircling the plurality of holes are first and second concentric circles of openings having passage means within the plate which place the first and second circles of openings in communication. A suction valve covers the first circle of openings and the valve further includes a sealing surface between the first and second circle of openings is placed in registry with an annular recess in the shoulder and the first circle of openings is in communication with the cylinder.

The present invention is concerned with valve means more nearly analogous to that of the Gerties patent, however, incorporating improved manufacturing techniques and construction, thereby resulting in an improved valve means that is relatively inexpensively fabricated.

BRIEF DESCRIPTION OF THE PRESENT INVENTION

There is shown in the attached drawing a presently preferred embodiment of the present invention, wherein like numerals in the various views refere to like elements, and wherein.

DETAILED DESCRIPTION OF THE PRESENT INVENTION

Figure 1:
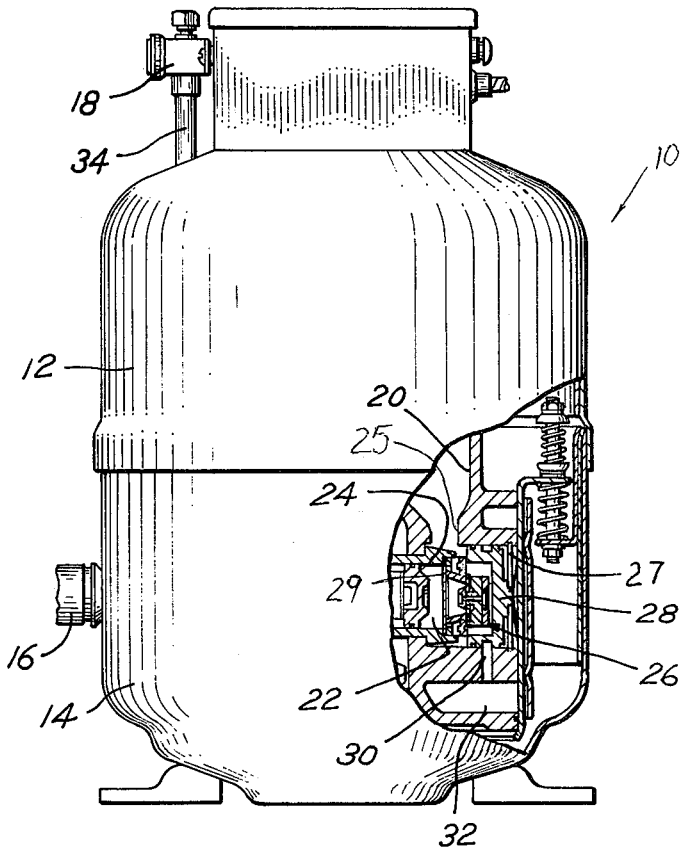
FIG. 1 is an elevation view of a reciprocating compressor embodying valve means of the present invention.
Figure 2:
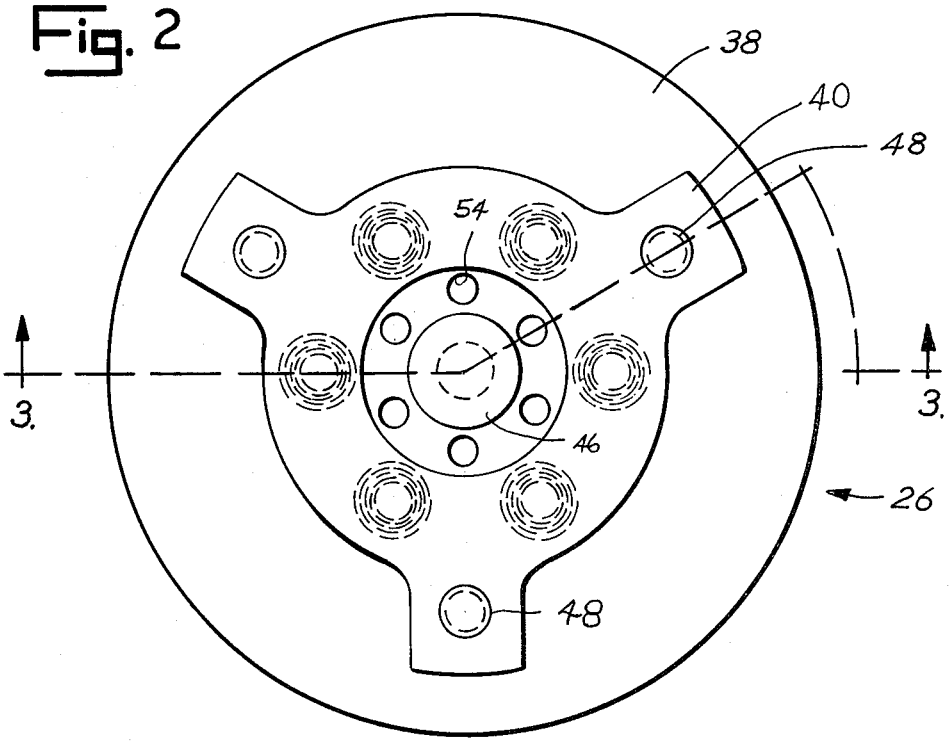
FIG. 2 is a top plan view of the valve means of the present invention.
Figure 3:
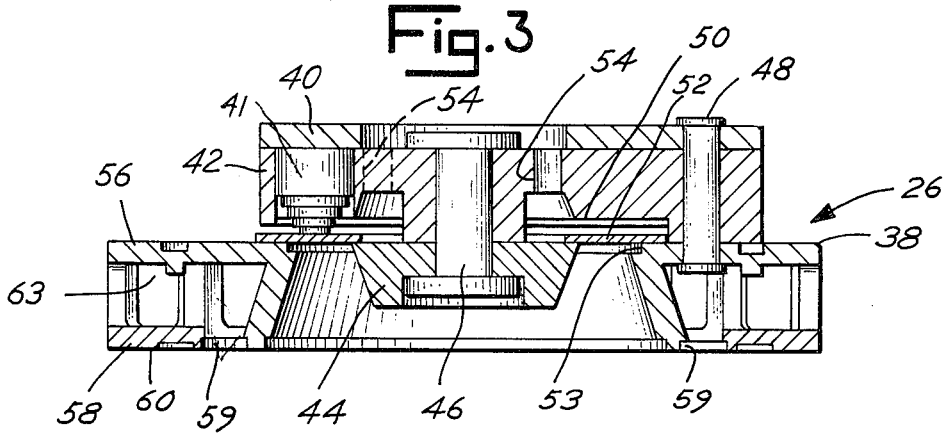
FIG. 3 is a cross sectional view of the valve means taken generally along the line 3—3 of FIG. 2.
Figure 4:
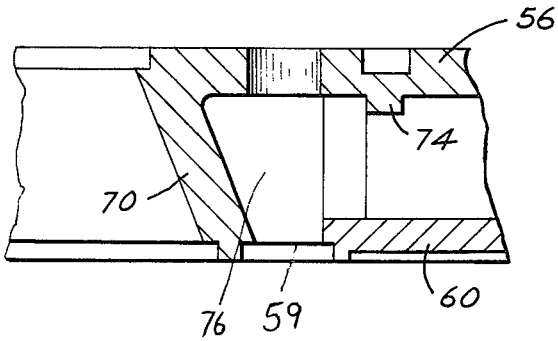
FIG. 4 is a detail view of the main body of the present invention.

Referring to FIG. 1 there is illustrated a reciprocating compressor 10 embodying the present invention. The reciprocating compressor 10 comprises an outer shell including an upper casing 12 and a lower casing 14 bonded together to form a hermetic enclosed unit. The reciprocating compressor 10 is in a refrigeration system of the usual condenser, expansion means, evaporator type and is connected to the system so as to receive suction gases through the suction inlet 16 and discharge the discharge gas to the system via the discharge outlet 18.

Resiliently disposed within the reciprocating compressor 10 is a compressor block 20 which has defined therein cylinder means 22. A reciprocating piston 24 is adapted to move in the cylinder means so as to draw suction gases into the cylinder means during the suction stroke and to discharge high pressure discharge gases from the cylinder means on the discharge stroke. The end of the cylinder means is closed by valve means 26 embodying the present invention, such valve means being retained in place by the valve head 28 which is retained in position by a retaining ring 27.

In operation of the compressor, suction gas enters the compressor 10 through the suction inlet 16 and pass through the space between the outer casing and the compressor block 20 into the valve means 26 through the inlet 25 in the compressor block 20. The gas flows through the valve means 26 and is drawn into the cylinder means during the suction stroke. On the discharge stroke, the gas is compressed and then passed from the valve means 26 through the discharge port 30 into the discharge collection chamber 32 within the compressor block and is then forwarded from the discharge chamber 32 through the conduit 34 and is discharged from the discharge outlet 18 to the refrigeration system.

With reference to the remaining FIGS. 2–6, there is better illustrated the valve means comprising the present invention. The valve means 26 comprises a discharge valve guide member 42 and separate plate member 40 secured to the main valve body 38. The valve button 44 and discharge valve guide 42 are joined to one another by means of pin 46. The plate member 40 and discharge valve guide member 42 are secured to one another and to the main valve body 38 by means of the pins 48. Retained in the recess 50 of discharge valve guide 42 is a discharge valve 52 for controlling the flow of discharge gas. The discharge valve 52, which may be made from Swedish steel, is a planar member that is retained in the recess 50 by means of the discharge valve guide 42. Springs 41 bias the discharge valve 52 closed.

Figure 5:
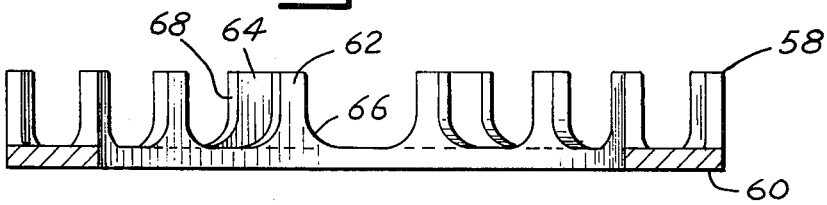
FIG. 5 is a side elevation view of the base which comprises a portion of the main body.
Figure 6:
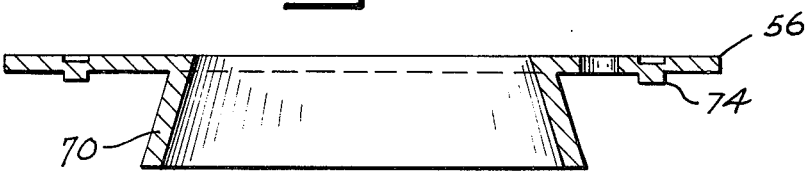
FIG. 6 is a side elevation view of the top which comprises a portion of the main body.

As best seen in FIGS. 5 and 6, the main valve body 38 is comprised of an upper member 56 and a lower member 58. The lower member comprises a base 60 having a pair of upstanding wall members 62, 64 extending therefrom. The inner wall member 62 and the outer wall member 64 are generally concentric one with respect to the other about the axis of the main valve body 38. Each set of wall members 64 and 62 forms a U-shaped passageway for suction gas. Many sets of the U-shaped passageways form a corridor. The upper member 56 is secured to the ends of the wall members 62 and 64 so as to define an annular passageway between the upper member 56, the base 60 and the wall members 62, 64.

It will be understood that suction gas will pass through the inlet 25 in the compressor block and the openings in the outer wall 64 into passageway 63 and through passageway 66 in inner wall member 62 to an assembly formed passageway 76 of the main valve body into the cylinder through the suction valve. During the suction stroke, the suction gas is drawn into the cylinder means through the suction inlet 25, the passageway in the main valve body 38 and suction openings 59, and into the cylinder means 22 through the suction valve 29. During the discharge stroke, the suction valve 29 is closed, blocking communication to the passageway in the main valve body 38 and high pressure gas passes through the opening 53, the discharge valve 52 which is off its seat, and through the discharge port 30 to the discharge chamber from which the gas passes to the conduit 34 for discharge into the refrigeration system. Some of the discharge gas passes through the openings 54 in the main body enroute to the discharge port 30.

The member 56 incorporates a truncated conical portion 70 which is adapted to cooperate with the top of the piston 24 so as to maximize the compression of the gas within the cylinder. An annular ring 74 projects from the member 56 and is adapted to cooperate with the upstanding wall member 62 to help orient the two portions 56, 58 of the main valve body for assembly. Assembly is completed by brazing the portions one to the other.

The flow passage 63 through the main valve body has a relatively large volume and includes relatively large openings in wall members 64 and 62. The annular flow passage 63 within the main valve body 38 provides for freer breathing or greater ease of gas flow and hence less pressure drop through the main valve body than hitherto has been obtainable.

Fabrication of the main valve body 38 is easy and a main valve body made in accordance with the present invention presently costs about one half as much as a typical screw machined construction.

There has been described a novel valve means for a reciprocating compressor which are relatively inexpensive to fabricate. The main valve body provides relatively large volume flow passage to minimize pressure drop through the valve means in use.

While a preferred form of the present invention has been described for purposes of illustration, it will be appreciated that this invention may be otherwise embodied within the scope of the following claims.

What is claimed is:

1. In a reciprocating compressor having cylinder means and a piston operable therein and valve means for controlling the passage of suction gas to the cylinder means and the discharge of discharge gas from the cylinder means, characterized by the valve means comprising a main valve body, said main valve body comprising a base having an inner annular wall member and an outer annular wall member extending therefrom, the outer wall member being spaced radially outwardly from the inner wall member and the wall members being in spaced concentric relationship, said wall members having a plurality of spaced recesses therein and a top secured to the ends of the wall members remote from the base so as to define a passageway having a plurality of openings in both the inner wall member and the outer wall member, said top being planar and including a truncated conical portion extending therefrom, the base and the top being bonded to one another to form the main valve body, said passageway having a relatively large volume and the openings in the inner wall member and the outer wall member being relatively large to provide reduced pressure drop of the gas flow through the main valve body, said suction gas entering said passageway through the openings in the outer wall member.

2. A device as in claim 1 wherein the base and top are brazed together.

3. A device as in claim 1 including complementary orienting means on the base and top for properly orienting the base and top for assembly.

4. A device as in claim 1 wherein the valve means includes a discharge valve assembly secured to the main valve body.

5. A device as in claim 4 wherein the discharge valve assembly includes a keeper plate secured to the main valve body, a cage secured to the keeper plate, discharge opening means in the discharge valve assembly, and a discharge valve disposed between the cage and keeper plate for controlling the passage of discharge gas through said discharge opening means.

* * * * *